US005473236A

United States Patent [19]

Frolov

[11] Patent Number: 5,473,236

[45] Date of Patent: Dec. 5, 1995

[54] ELECTRONIC LOCK SYSTEM FOR DOOR LATCH ASSEMBLY

[75] Inventor: George Frolov, Farmington, Conn.

[73] Assignee: Harrow Products, Inc., Grand Rapids, Mich.

[21] Appl. No.: 275,301

[22] Filed: Jul. 14, 1994

[51] Int. Cl.[6] ..... E05B 47/00

[52] U.S. Cl. ..... 318/286; 318/265; 70/277

[58] Field of Search ..... 318/264, 265, 318/266, 286, 466, 468; 340/542; 70/91, 101, 106, 141, 275, 277, 278, 280, 284, 285, 413

[56] References Cited

U.S. PATENT DOCUMENTS 3,622,991 11/1971 Lehrer et al. .
4,433,355 2/1984 Chew et al. .
4,534,194 8/1985 Aydin .
4,616,491 10/1986 Genest .
4,833,465 5/1989 Abend et al. .
4,848,115 7/1989 Clarkson et al. .
5,020,345 6/1991 Gartner et al. .
5,437,174 8/1995 Aydin ..... 70/278

*Primary Examiner*—Bentsu Ro
*Attorney, Agent, or Firm*—Chilton, Alix & Van Kirk

[57] ABSTRACT

An electronic lock assembly mounts to the opposite sides of a door to provide an electronically operable level of security. An electronic reader generates a signal which is employed to control the operation of a conventional latch installation. A card reader, key pad or contact activatable data port generates a signal to actuate a motor to disengage a locking dog to thereby allow rotation of the latch handle. The motor shaft is connected to a drive screw by a coil spring to permit proper operation if a jamming condition is present.

20 Claims, 6 Drawing Sheets

ELECTRONIC LOCK SYSTEM FOR DOOR LATCH ASSEMBLY

BACKGROUND OF THE INVENTION

This invention relates generally to a handle operated door latch assembly which may or may not incorporate a cylindrical lock . More particularly, the present invention relates generally to electronic door lock systems which provide an additional level of door lock security.

For buildings which have multiple interior secured areas, such as apartment houses, dormitories, hotels, etc., it is common for the door to have a latch which is operable on both sides of the door by means of a handle having various forms.

For security systems which are based on a conventional lockable latching mechanism, security can be dramatically compromised by transient users of the system. Keys can be easily replicated. Once a tenant or occupant no longer lawfully occupies the secured area, the key or a copy of the key may be knowingly possessed by one no longer entitled to access. Consequently, proper security standards may require that the lock be removed in its entirely and replaced. Naturally, the replacement of otherwise mechanically sound hardware can be a costly, time consuming and inefficient process for ensuring security.

Innovations in security systems for tenants have increasingly been directed to electronic lock systems which employ programmable processors to identify valid pass codes for obtaining entry into a restricted area and to record information concerning such an entry. Card readers, key pads and contact activatable data ports are now commonly used to gain access to restricted areas.

SUMMARY OF THE INVENTION

Briefly stated, the invention in a preferred form is an electronic lock system for a door latch assembly which may employ a cylindrical lock. The lock system has particular applicability in connection with a conventional cylindrical lock door latch assembly which latch assembly employs a latch having handles at the interior and exterior sides for operating the latch.

The electronic lock may include a card reader, a key pad, a contact activatable data port, a terminal or other electronic security reader at the exterior side of the door. The electronic reader preferably mounts above the latch assembly. A motor controlled coupling assembly is rotatably fixed with a locking dog of the latch assembly. The motor is connected to the lock locking dog by a coil spring. A signal from the electronic reader activates the motor to operate the lock and hence permit retraction of the latch by the exterior latch operator.

Should the locking dog mechanism be held fixed in either the locked or unlocked position by external means, the motor will cause the spring to be compressed or be stretched. Therefore, the spring will return to its normal configuration when the external means is removed, causing the locking dog mechanism to be moved to the unlocked or locked position.

A housing for the power supply and the other components of the electronic lock are mounted at the inside of the door.

An object of the invention is to provide a new and improved auxiliary security level for a conventional lockable latch security system.

Another object of the invention is to provide a new and improved electronically operable security level for a conventional type latch assembly.

A further object of the invention is to provide a new and improved device and system which operates in an inexpensive and efficient manner in conjunction with a conventional cylindrical lock installation.

Other objects and advantages of the invention will become apparent from the drawings and the specification.

DETAILED DESCRIPTION OF THE PREFERRED EMBODIMENT

Figure 1:
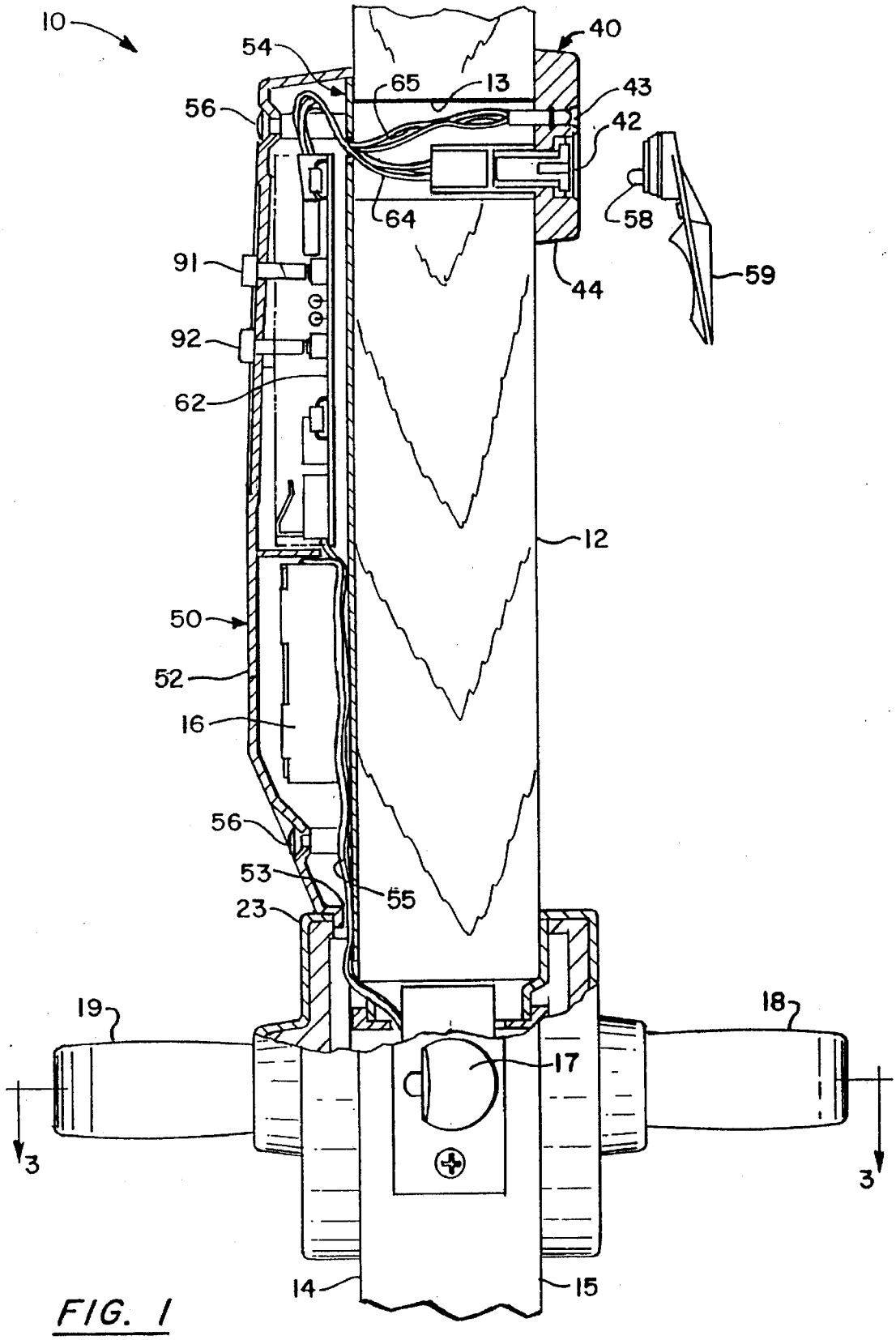
FIG. 1 is an end view, partly broken away, partly in section, partly in phantom and partly in schematic, of a portion of a door having a cylindrical lock latch assembly lock, a latch and an electronic lock system in accordance with the present invention.
Figure 2:
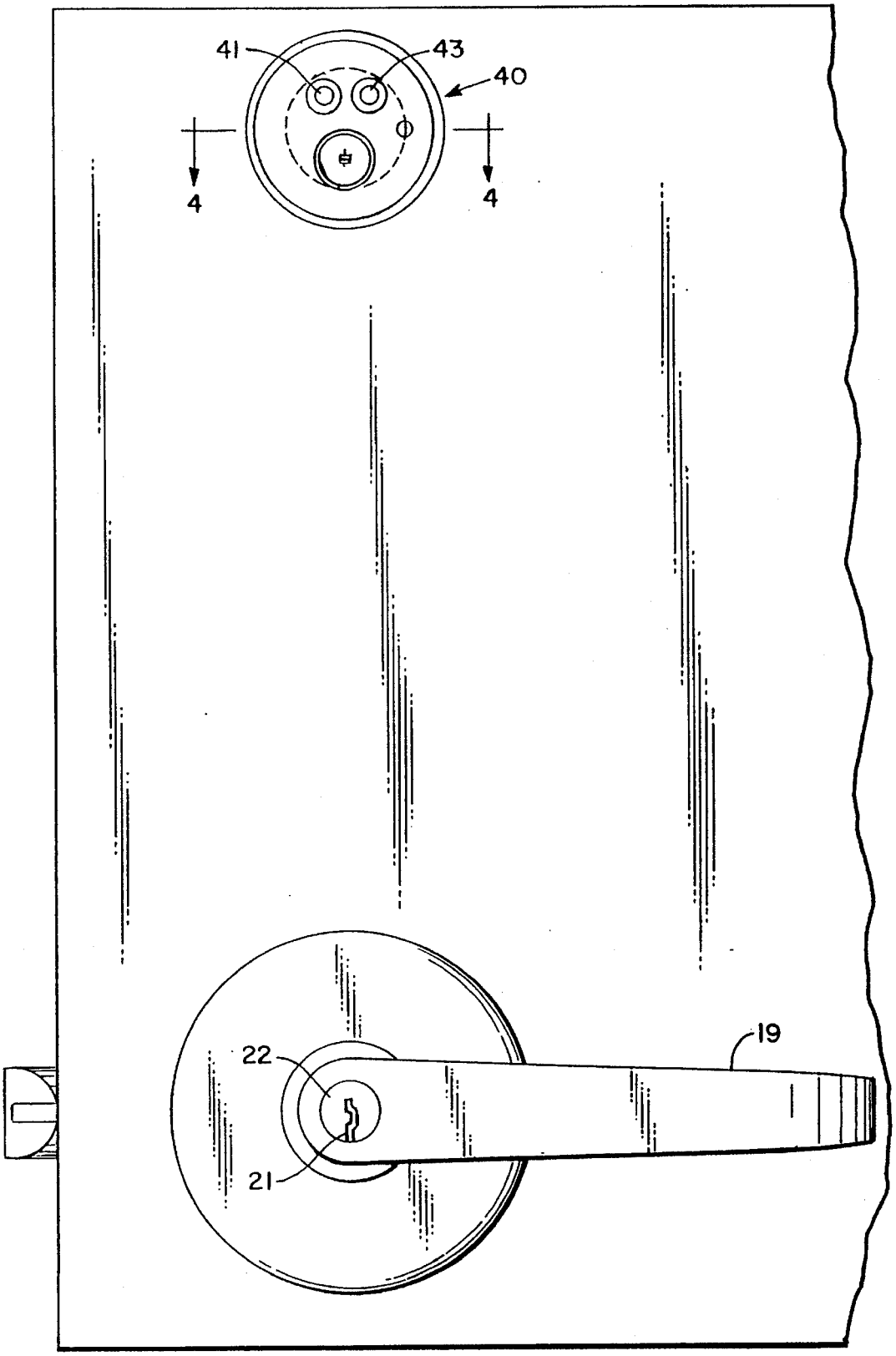
FIG. 2 is an exterior side elevational view, partly in phantom, of the door, the latch assembly and the electronic lock system of FIG. 1 viewed from the right thereof.

With reference to the drawings, wherein like numerals represent like parts throughout the figures, an electronic lock assembly in accordance with the present invention is generally designated by the numeral 10. The electronic lock assembly 10 is especially adapted for mounting to a door 12 which employs a conventional lockable or non-lockable latch 17. The door 12 has an interior restricted or secured side 14 and an exterior side 15.

The latch 17 is typically operable by a handle 18 at the exterior side and a handle 19 at the secured side. The handles 18 and 19 may assume various forms including levers as illustrated, knobs, and other well known operator hardware. The electronic lock assembly has application in a wide variety of doorway/lock set configurations, including installations wherein the latch is locked by means of a cylindrical lock.

For some applications wherein a key-operated override of the lock system is desired, the latch assembly employs a conventional cylindrical lock having a keyway 21 which, in the illustrated embodiment, is accessible at the exterior side. The lock 20 is operable by means of a proper key (not shown) for rotating the cylinder plug 22. A flat extension shaft 24 extends from the cylinder plug 22 and engages the latch 17 by means of a conventional operator assembly.

The electronic lock assembly 10 comprises a frontal subassembly 40 which mounts against the front face of the exterior side 15 of the door above the cylindrical lock latch assembly and a cooperative rear subassembly 50 which mounts against the secured side 14 of the door above the handle 19.

Figure 4:
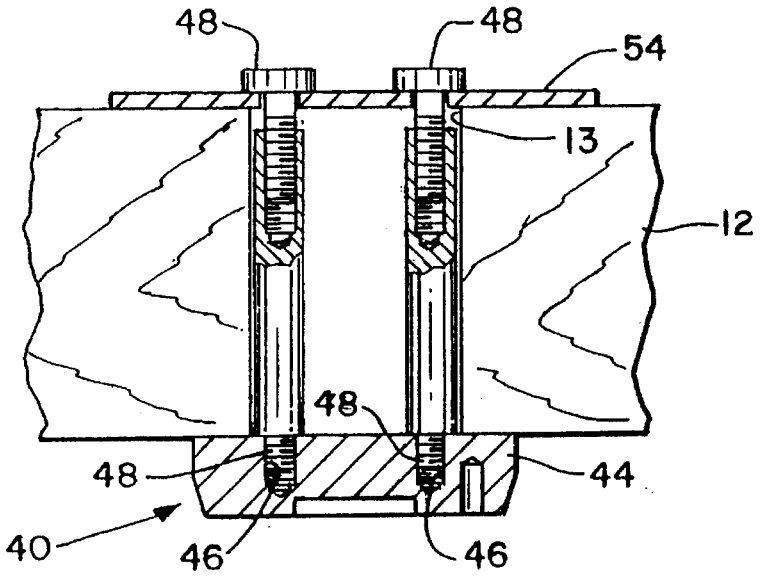
FIG. 4 is an enlarged fragmentary sectional view of the door, the latch assembly and the electronic lock system of FIG. 1 taken along the line 4—4 of FIG. 2.
Figure 5:
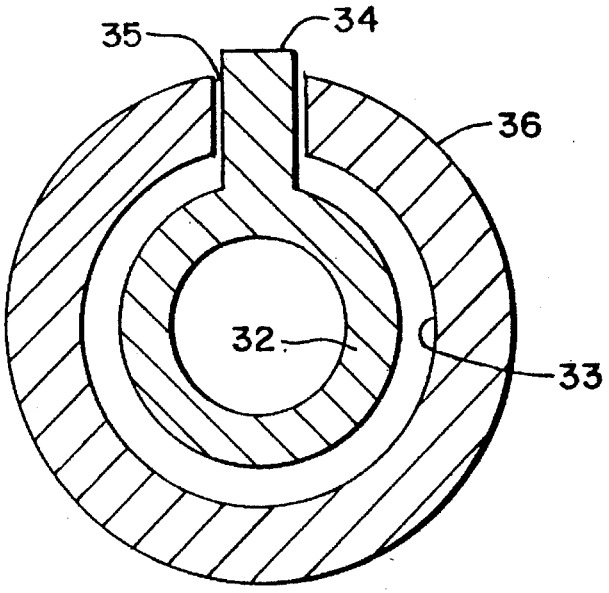
FIG. 5 is an enlarged cross-sectional view of a locking dog and receiver of the electronic lock system of FIG. 1.

The frontal subassembly 40 comprises an electronic reader, as described hereafter, and may assume a number of other forms. Regardless of form, the frontal subassembly preferably has a case 44 which has interior threaded sockets 46 (FIG. 4). Elongated fasteners or bolt assemblies 48 extend from the rear subassembly through a bore 13 drilled through the door and are anchored in the sockets 46 for securing the subassemblies 40 and 50 in fixed position at the opposite sides of the door.

The rear subassembly 50 includes a cover 52 which mounts over the base plate 54 mounted against the secured side 14 of the door 12. The cover 52 extends to downwardly terminate adjacent the rose 23 of the handle 19. The lower portion of the cover has a slot 53 which is dimensioned to provide a clearance between the cover and the door for electrical leads 55 so that the leads are protected by the cover. Fasteners 56 secure the cover 52 to the base plate 54.

Batteries 16 are mounted in parallel at the housing interior. An electrical lead from the batteries connects via circuitry 60 (FIG. 7) mounted on a circuit board 62 at an upper location of the housing to supply power to a bi-directional motor 72 and the frontal subassembly 40, as will be described below.

With reference to FIGS. 1, 2, 4 and 7, the frontal subassembly 40, which mounts a security control, may incorporate an electronic reader 42 having a contact activatable data port 45, such as 780 Series Touch Entry™ access control systems of Locknetics Security Engineering. Access through the door 12 is thus obtained via a ROM chip 58 which has a pre-established code. The chip 58 may be mounted to a fob 59. The chip 58 essentially functions as a key. A green LED 41 and a red LED 43 may also be mounted at the frontal face to provide a visual indication of the status of the data port reader 42.

Alternatively, the frontal assembly 40 may incorporate a card reader; a reader having a membrane key pad such as 770 Series Smart Entry™ access control systems of Locknetics Security Engineering, Forestville, Connecticut; a keyboard; or other electronic readers or access controls (not illustrated), such as an eye-scanner, a palm reader, etc.

The electronic readers generate a release signal via electrical leads 64 which is applied to the circuitry 60 for the motor 72. If a valid key, pass code, card, data chip or other electronic access device is employed, the release signal is generated. The release signal is applied through a driver 70 via leads 55 for energizing the motor 72 for a pre-established time interval to thereby rotate the motor drive shaft 73 in the proper direction.

The motor 72 is mounted at the inside of handle 19 and has a drive shaft 73 having an axis 71 that is substantially coaxial with the axis 25 of the handles 18, 19. Preferably, the motor 72 is a low speed, high torque micro motor with no gear box such as, for example, a Mabuchi FF-050SH-09250 micro motor. A first end 27 of a coil spring 26 is fixedly mounted on the motor drive shaft 73. A drive screw 30 is fixedly mounted to the second end 28 of the coil spring 26. The drive screw 30 is coaxially received by a threaded axial bore 33 in the locking dog 32. Activation of the motor 72 causes the motor drive shaft 73, the coil spring 26, and the drive screw 30 to rotate. The drive screw 30 threadably engages the locking dog 32 and thereby causes lateral movement of the locking dog 32.

Figure 3:
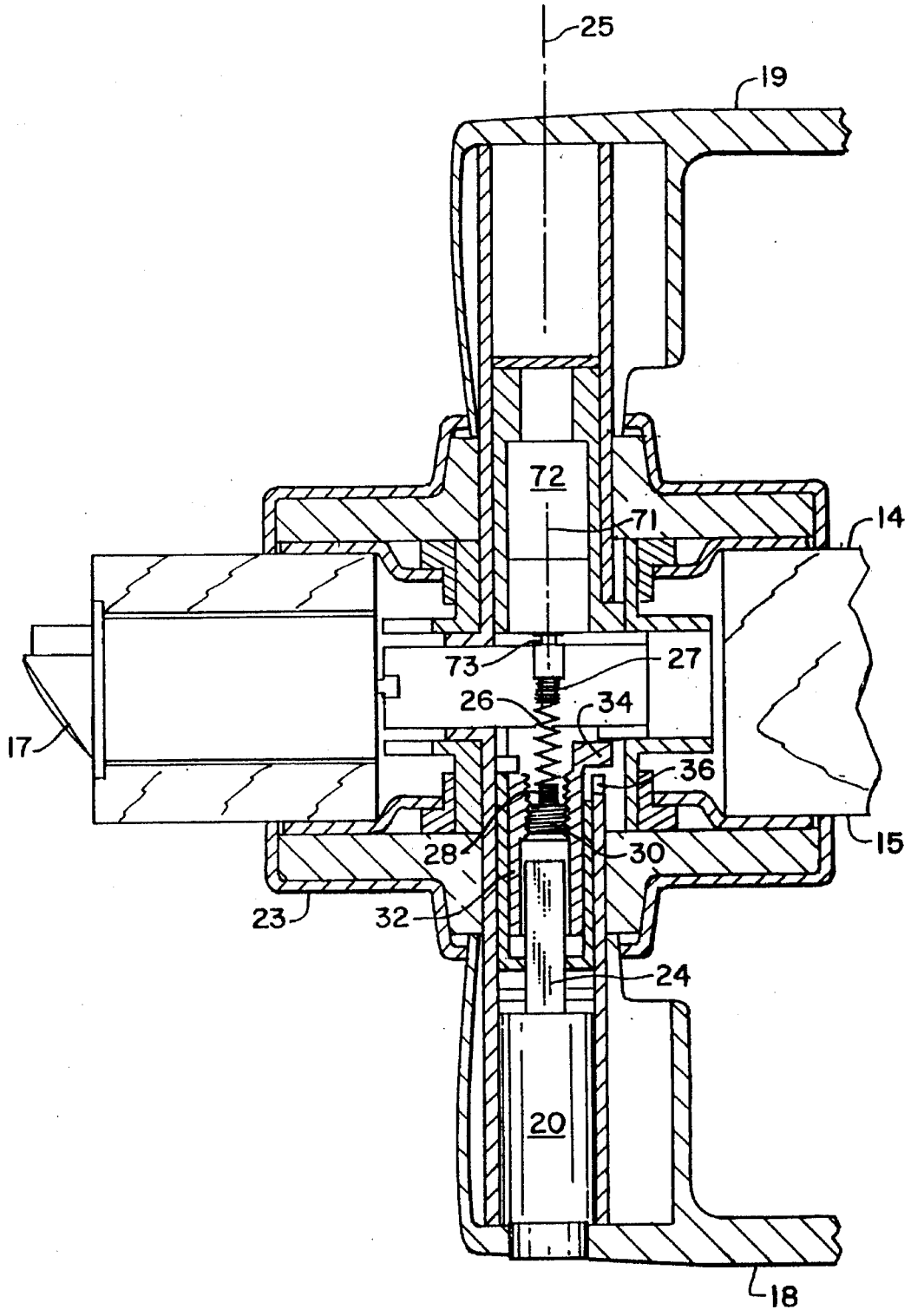
FIG. 3 is a fragmentary sectional view of the door, the latch assembly and the electronic lock system of FIG. 1 taken along the line 3—3 of FIG. 1.

The locking dog 32 is shown in the unlocked position in FIG. 3. The lock command causes the locking dog 32 to move laterally towards the exterior handle 18 due to the rotation of the drive screw 30 in the forward rotation direction. When the locking dog 32 is in the locked position, an outwardly projecting tang 34 is received in a slot 35 in a receiver 36 and is thereby prevented from being rotated by the handle 18. The unlock command causes the drive shaft 73 and drive screw 30 to rotate in a reverse direction to force the locking dog 32 to move laterally away from the exterior handle 18, moving the tang 34 out of the slot 35.

A pre-established delay time interval such as, for example, 5 seconds, is preferably imposed upon the circuitry 60 to allow sufficient time to operate the latch. The length of the time delay interval may be programmable. Upon termination of the delay period, the circuitry 60 reverses the motor 72, engaging the locking dog tang 34 in the receiver slot 35 and locking the door 12. The exterior handle 18 will operate the latch 17 when the tang 34 is clear of the slot 35. Alternatively, the lock may be operated in the maintained lock or unlocked operation. The lock 20 need not be operated by the key. However, the key may be used to manually override the electronic lock system.

Should the locking dog 32 be physically restrained by an outside jam force, a lock/unlock command will cause rotation of the drive screw 30 within the locking dog bore 33. Rotation in the unlock direction will cause the drive screw 30 to move towards the exterior handle 18, causing the spring 26 to be stretched. Rotation in the lock direction will cause the drive screw 30 to move away from the exterior handle 18, causing the spring 26 to be compressed. When the outside force is removed, the spring 26 will return to its original condition, thereby laterally moving the locking dog 32 and locking/unlocking the lock 10.

Figure 6:
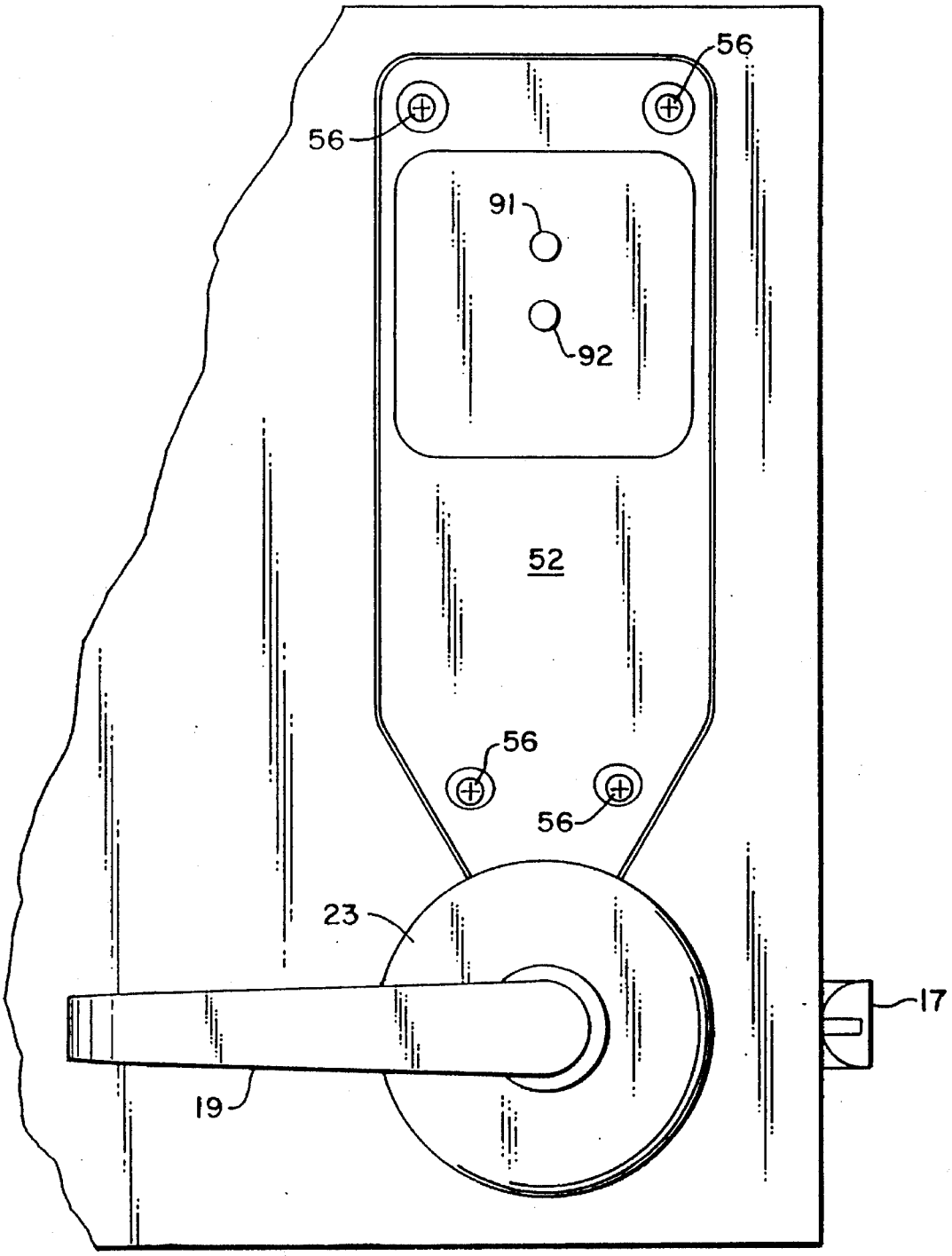
FIG. 6 is an interior side elevational view, partly in phantom, of the door, the assembly and the electronic lock system of FIG. 1 viewed from the left thereof.
Figure 7:
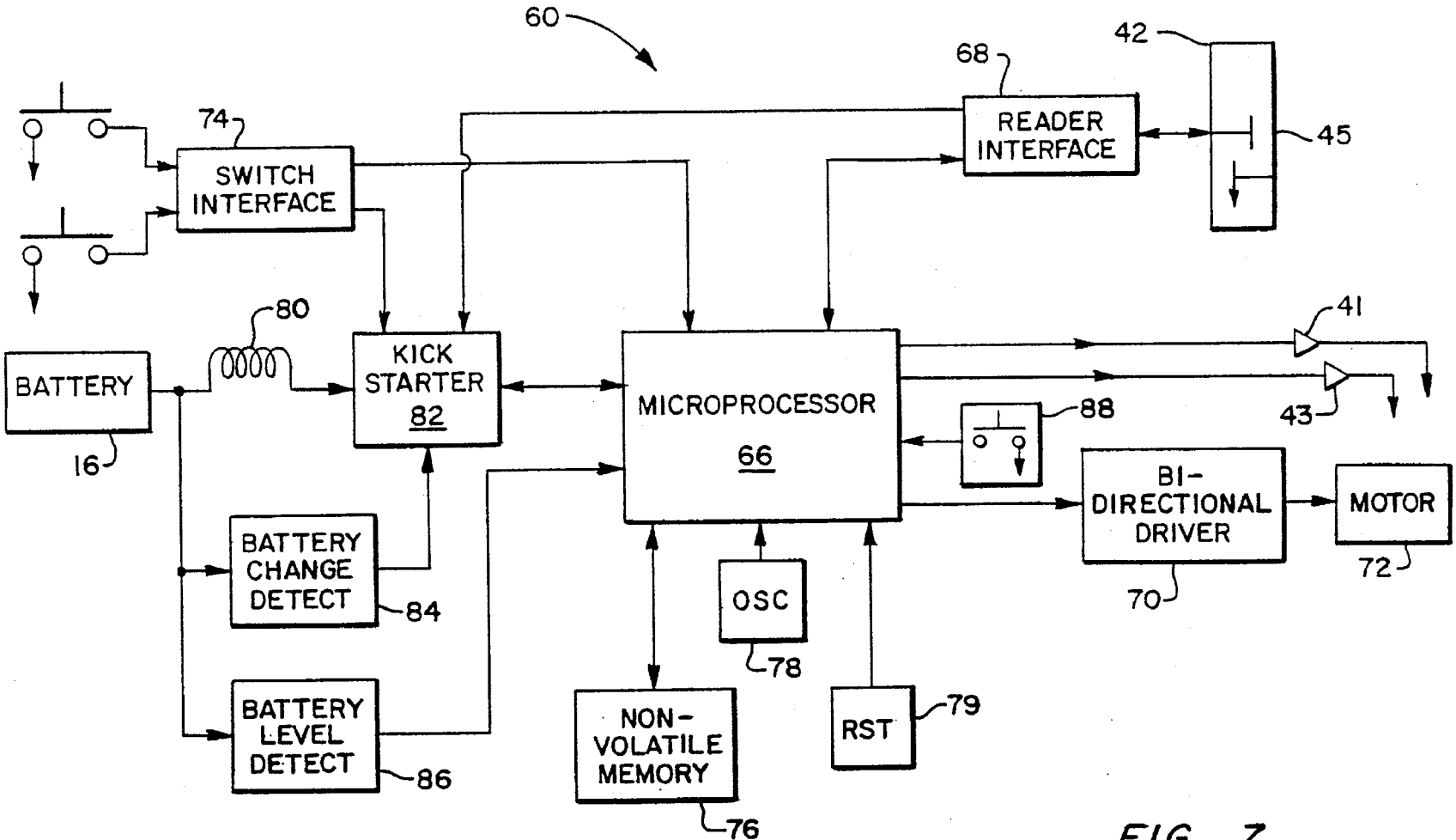
FIG. 7 is a schematic block diagram of the electronic lock system of FIG. 1.

With reference to FIG. 7, the circuitry 60 comprises a microprocessor 66 which communicates with the reader 42 via a reader interface 68. The microprocessor 66 processes information and data to enable detection of a valid passcode. The microprocessor 66 also generates appropriate signals to the LEDs 41 and 43. If a valid passcode is detected, the microprocessor 66 will generate signals for a bi-directional driver 70 which drives a motor 72 for controlling the position of the locking dog 32. A switch interface 74 for clearing the memory of the microprocessor 66 and initiating a programming mode also communicates with the microprocessor 66. The microprocessor 66 also communicates with the non-volatile memory 76 which contains the authorized passcodes and configuration data. The microprocessor 66 and the various functions are regulated by an oscillator 78. A power on reset circuit 79 also provides an input to the microprocessor 66 to commence the operating mode. Manual override switches 91, 92 (FIGS. 1 and 6) may be provided to lock and unlock the door from the inside. An audit trail chip, such as a Dallas Semiconductor DS 1994 chip, keeps time and the microprocessor 66 records each electronic operation of the lock 10 in the audit trail memory. This memory may be accessed to provide a chronological history of each lock/unlock event.

The batteries 16 connect via an inductor 80 with a Dallas Semiconductor DS 1227 kick-starter 82 which in one embodiment provides a 5 volt power supply to the circuit components. A battery change detection circuit 84 and a battery level detection circuit 86 are also incorporated into the circuitry. If the battery level is above a pre-established value, the green LED 41 will pulse when access is obtained through the auxiliary reader or lock. If the battery level is not above the value, the red LED 43 will pulse and thus provide an indication that the batteries should be replaced. A truncating switch 88 incorporated into the lock also can be used to truncate the time delay interval if the unlocking is completed to thereby conserve the power supply.

Installation of the electronic lock assembly 10 does not require extensive modification of the door or the latch lockset. Door modification may essentially be limited to drilling bore 13. The motor 72, coil spring 26, and drive screw 30 are installed from the secured side 14 of the door 12. The locking dog 32 is installed from the exterior side 15 of the door 12 and threadably connected to the drive screw 30. The frontal and rear subassemblies 40, 50 are then positioned. The electrical leads 24, 64, and 65 are passed through the door and connected to the circuitry 60. The subassemblies 40, 50 are secured in position by fasteners 48. The batteries 16 may be pre-installed. The cover 52 is then mounted to the base plate 54.

It will be appreciated that the electronic lock assembly 10 can be mounted to the door in a relatively efficient installation process to provide an electronic level of security at the door. Access to the secured area can be obtained by a valid input entered by the user at the key pad or via a card, data chip, or other means.

The installation is accomplished by leaving the cylindrical body of the lock intact and by implementing insubstantial changes to the door and the latch mechanism which is already in place. Preferably an onboard power supply (battery) is employed although the electronic lock system could also be adapted for an electrified door.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A door lock system comprising: door means having opposite first and second sides; latch means for latching said door means comprising a latch and first operating means at said first side for operating said latch;

electronic lock means comprising an input means accessible at said first side for generating an electrical signal in response to a pre-established input;

engagement means comprising a locking dog, said locking dog being engageable with a receiver for preventing operation of said latch;

driving means responsive to said electrical signal for engaging and disengaging said locking dog with said receiver; and coupling means for coupling said driving means and said engagement means, said coupling means comprising a spring and drive screw means, said spring having first and second end portions, said spring first end portion being fixedly coupled to said driving means, said spring second end portion being fixedly coupled to said drive screw means, said drive screw means being threadably engaged with said engagement means, wherein said driving means rotates said coupling means to displace said engagement means.

2. The door lock system of claim 1 wherein said locking dog defines an axial longitudinal bore having a threaded surface.

3. The door lock system of claim 2 wherein said drive screw means has a threaded first portion, said drive screw means threaded portion being received by said locking dog bore wherein said drive screw means is threadably engaged with said locking dog.

4. The door lock system of claim 3 wherein said drive screw means further comprises a second portion, said spring second end portion being fixedly mounted to said drive screw means second portion.

5. The door lock system of claim 1 wherein said spring has a normal state and is transformable to a stretched state when said signal for engaging is generated and said engagement means is prevented from linear movement by an external agent, said spring permitting said drive screw means to continue rotational motion, wherein said spring returns to said normal state when said external agent is removed so that said engagement means is moved to an engaged position.

6. The door lock system of claim 1 wherein said spring has a normal state and is transformed to a compressed state when said signal for disengaging is generated and said engagement means is prevented from linear movement by an external agent, said spring permitting said drive screw means to continue rotational motion, wherein said spring returns to said normal state when said external agent is removed so that said engagement means is moved to a disengaged position.

7. The door lock system of claim 1 wherein said driving means comprises a motor.

8. The door lock system of claim 3 wherein said driving means is located at said second side of said door.

9. The door lock system of claim 1 wherein said input means comprises an electronic card reader.

10. The door lock system of claim 1 wherein said input means comprises an electronic contact activatable data port.

11. The door lock system of claim 1 wherein said input means comprises a key pad.

12. An electronic lock system for adding a security level to a door having a latch operable by a rotatable handle accessible at a first side for operation thereof comprising:

electronic reader means for electronically reading an input;

engagement means engageable with a receiver for preventing operation of said latch;

lock means responsive to said electronic reader means for operating said engagement means, said lock means comprising a motor having a drive shaft;

coupling means for coupling said drive shaft to said engagement means, said coupling means comprising a spring and a drive screw, said spring being fixedly coupled to said drive shaft and fixedly coupled to said drive screw, said drive screw being threadably engaged with said engagement means, wherein said drive shaft drives said coupling means to displace said engagement means to thereby engage or disengage said receiver;

power supply means for supplying power to said lock means and said reader means; and mounting means for mounting said coupling means, lock means, supply means, and said electronic reader means to said door, wherein said latch may be selectively unlocked by a valid input at said electronic reader means.

13. The electronic lock system of claim 12 wherein said lock means comprises a bi-directional motor generally coaxial with said engagement means.

14. The electronic lock system of claim 12 wherein said electronic reader means comprises a card reader.

15. The electronic lock system of claim 12 wherein said electronic reader means comprises a key pad.

16. The electronic lock system of claim 12 wherein said electronic reader means comprises a contact activatable data port.

17. The electronic lock system of claim 12 wherein said power supply means comprises a battery.

18. A door lock system comprising: door means having opposite first and second sides; latch means for latching said door means comprising a latch and handle means at said first and second sides for operating said latch, said handle means defining an axis;

input means accessible at said first side for generating an electrical release signal in response to a valid input;

engagement means engageable with a receiver for preventing operation of said latch;

lock means for imposing a lock condition on said latch and responsive to said signal, said lock means comprising a motor having a drive shaft defining an axis wherein said motor axis is coaxial with said handle axis; and coupling means for coupling said lock means to said engagement means, said coupling means comprising a spring and drive screw means, said spring being fixedly coupled to said motor and fixedly coupled to said drive screw means, said drive screw means being threadably engaged with said engagement means, wherein said drive shaft rotates said coupling means whereby said drive screw means displaces said engagement means to engage or disengage said receiver.

19. The door lock system of claim 18 wherein, wherein said spring is axially compressed when said release signal is generated and said engagement means is prevented from linear movement by an external agent, said spring permitting said drive screw means to continue rotational motion, wherein said spring axially expands when said external agent is removed to force said engagement means to a disengaged position.

20. The door lock system of claim 18 wherein said motor is a low speed, high torque micro motor.

* * * * *